United States Patent [19]

Furendal et al.

[11] 4,293,596

[45] Oct. 6, 1981

[54] SURFACE COATING METHOD EMPLOYING A TEMPORARY BONDING

[75] Inventors: Allan R. B. Furendal; Bernt Larsson; Erik R. Nilsson, all of Karlskoga, Sweden

[73] Assignee: AB Bofors, Bofors, Sweden

[21] Appl. No.: 673,843

[22] Filed: Apr. 5, 1976

[30] Foreign Application Priority Data

Apr. 11, 1975 [SE] Sweden ..... 7504193

[51] Int. Cl.[3] ..... B05B 5/00; B05D 3/04

[52] U.S. Cl. ..... 427/160; 427/54.1; 427/137; 427/335; 427/379; 427/385.5; 427/388.4; 427/389.7; 427/389.9; 427/391; 427/393; 427/393.5; 427/393.6

[58] Field of Search ..... 427/27, 29, 189, 195, 427/201, 335, 385.5, 389.7, 388.4, 393.5, 137, 541, 160, 379, 393.6, 389.9, 393, 391

[56] References Cited

U.S. PATENT DOCUMENTS

| | | | |
|---|---|---|---|
| 1,141,224 | 6/1915 | Wawrziniok | 427/189 |
| 2,748,019 | 5/1956 | Schramm | 427/201 |
| 3,288,624 | 11/1966 | Clark | 427/189 |
| 3,383,775 | 5/1968 | Jacob et al. | 427/335 |
| 3,565,665 | 2/1971 | Stranch et al. | 427/29 |
| 3,676,172 | 7/1972 | Van Dyk et al. | 427/209 |

FOREIGN PATENT DOCUMENTS

| | | | |
|---|---|---|---|
| 2176395 | 10/1973 | France | 427/44 |

*Primary Examiner*—Ronald H. Smith
*Assistant Examiner*—S. L. Childs
*Attorney, Agent, or Firm*—Pollock, Vande Sande & Priddy

[57] ABSTRACT

A method of coating which involves applying to a surface a dispersion containing a main bonding agent and a temporary bonding agent. The main bonding agent is not film forming at room temperature. Next the continuous phase of the dispersion is permitted to evaporate or is driven off, followed by precipitation of the main bonding agent and the temporary bonding agent to form a porous powder layer on the surface. The temporary bonding agent bonds the main bonding agent to the surface. The porous layer is then exposed to a solvent which causes the particles of the bonding agents to flow together, and any excess solvent is removed.

30 Claims, No Drawings

SURFACE COATING METHOD EMPLOYING A TEMPORARY BONDING

BACKGROUND OF THE INVENTION

The present invention relates to a new surface coating or painting method which gives coherent paint and/or protective coatings, which can be given very good resistance to both chemical and mechanical damage. Although the method in question has primarily been conceived for use in connection with painting, it can also be used for a number of other purposes, for instance for permanently bonding grains or powdered material to a carrier of one kind or another.

In its general form, the method according to the invention can primarily be considered to constitute a new and entirely superior variant of the so-called powder paint procedure, according to the original concept of which, fine particles of a polymer which is not film forming at room temperature are applied to the surface which is to be coated, after which the paint particles are heated to a temperature well above the minimum film formation temperature (MFT) of the polymer, whereby the polymer particles are caused to be fused together to form a coherent layer. The heating can then take place after the particles have been applied to the surface in question, alternately the particles can be applied to a surface that has already been heated. Combinations of these two variants are also conceivable. In addition to applying the polymer particles in a dry condition to the surface in question, through e.g. so-called electrostatic coating, it has also previously been proposed to apply them in the form of a dispersion, the liquid component of which in such a case must be evaporated before the melting of the particles commences. These so-called dispersion paints have the advantage compared with other variants of powder paint that they are easier and cheaper to produce. A polymer dispersion with an appropriate particle size can be produced in a comparatively simple way by a concentrated polymer paint being charged into water under intensive stirring, the size of the particles then being determined by the recipe, the design of the equipment, the method of conveying the paint to the water, and the stirring speed. It is also easy to modify the water content subsequently in such a dispersion paint.

An advantage of the conventional powder paints that has previously been considered to be of great value is that these, at least in their original variants, are entirely free from solvent. According to a variant subsequently proposed, however, a minor quantity of solvent is added, in order to reduce the film formation temperature of the polymers.

In the U.S. Pat. No. 3,565,665, a further variant is proposed, according to which the surface which is to be protected is first coated with a porous layer containing particles of an appropriate polymer material, after which this layer is subjected to a solvent treatment which causes the particles to be fused together. It is proposed to provide the original porous layer by means of electrostatic coating, or by previously providing the surface which is to be coated with a sticky coat of glue.

Each of the above-mentioned methods has advantages and disadvantages, and the purpose of the present invention is to combine all of the favourable properties of these methods, and at the same time to eliminate as many of the earlier disadvantages as possible.

The hot film forming powder paints can thus be entirely free from solvent, but special methods, e.g. electrostatic coating, are required in order to apply them, at the same time as the heat resisting properties of the base limits the choice of conceivable polymers, as a satisfactory film formation requires heating well above the MFT of the polymer. In practice, the choice is thus limited to polymers with a low MFT value which, in turn, involves comparatively soft polymers, which usually do not have sufficient chemical and mechanical properties, and sometimes have a tendency towards sticking if the surfaces are painted and these are placed in contact with each other. When the method according to the invention is used, however, there is no limitation to polymers with a certain MFT. There is no need to apply the polymer material in question by means of expensive procedures of the type electrostatic coating, or through special separately applied bonding agents either, in this case.

SUMMARY OF THE INVENTION

The present invention thus relates to a new surface coating method, according to which, to the surface which is to be coated, a dispersion is applied, consisting of (1) a continuous phase which in most cases at least mainly contains water and in this continous phase, dispersing and/or dissolving components consisting of (2) a powdered polymer material, hereinafter called "main bonding agent" as it will constitute the bonding agent in the final coating (3) a temporary bonding agent, of which a considerably smaller quantity is used than of the main bonding agent, and which serves the purpose of, in the beginning, of fixing the particles of the main bonding agent to the base as well as optional components (4) of the type pigments, pigment dispersing agents, fillers, thickening agents, consistency controlling agents and, possibly, anti-corrosion agents etc.

When the dispersion has been applied to the surface in question, it is allowed to dry, i.e. the continuous phase is allowed to evaporate, or is driven off, e.g. through an increase of the temperature. If the drying takes place at an elevated temperature, this should be well below the MFT of the main bonding agent. At the drying, a uniform layer of non-film forming polymer particles and, if present, of pigment is formed. The powdered porous coating is held together and bonded to the base by the temporary bonding agent. When an appropriate type and quantity of temporary bonding agent is used, the coating has sufficient strength to withstand the handling in the form of transportation, stacking of the coated products on top of each other, jolting etc. to which the coated product may be subjected before the next stage, which is subjecting the coating to exposure with solvent. This involves that an appropriate solvent, in a sufficient quantity, is applied in order to swell, fuse or sinter the particles of the main bonding agent together into a coherent layer, in which the temporary bonding agent, possibly pigment and possibly other originally added components are baked in. The exposure can take place to vapour of the solvent, which is allowed to condense on the particles of bonding agent, or by a liquid solvent being applied by means of dipping in the solvent or by application with a brush, spraying, or in some other way. The exposure can also take place at different temperatures, and the sintering of the particles is then, of course, favoured by an elevated temperature; however, the temperature must not be so high that it becomes difficult for the solvent to condense on the polymer particles.

When the sintering together has been completed, the remaining solvent is driven off, appropriately in such a way that it can be condensed and recovered. The method also provides for a hardening of the coating thus produced.

It is also conceivable to use monomer solvents which partly remain in the sintered polymer coating, after which the solvent, in turn, is polymerized, e.g. by means of ultraviolet radiation.

By adding solid particles of a different character instead of pigment, a great number of other products can be produced, which will be described in more detail in the following.

Among the advantages of the method according to the invention, the following may be mentioned.

(1) No dry, possibly pigmented powder need be produced, as this is formed at the drying of the dispersion.

(2) The dispersion can be applied in an arbitrary, conventional manner.

(3) The coating dries rapidly, due to the porosity of the surface.

(4) Bases which do not withstand much heating can be coated.

(5) Small quantities of solvent, possibly in combination with a minor heating, are needed in order to achieve the sintering of the particles.

(6) As a rule, the solvent exposure can be carried out under such conditions that a large portion, often the major portion, of the solvent can be recovered.

(7) The use of solvent makes it possible to sinter polymers with a very high melting viscosity, caused e.g. by a high molecular weight. Sometimes such polymers can not be sintered with only heat. Many of these polymers are characterized by good physical and chemical properties, which makes them suitable for outdoor use.

(8) In the method according to the present invention, the viscosity of the polymer solvent coating at the time of sintering of the polymer particles is very high (and must be high in order to avoid flowing). Coatings which according to known techniques are applied as solutions in solvents, on the other hand, have a low viscosity, as they could otherwise not be applied. In order to obtain a reasonably low viscosity, it is therefore required that the polymers used have a low molecular weight. As a rule, the polymers used according to the invention have a high molecular weight. If these should be used, and applied as solvents, it would be necessary to use unrealistic quantities of solvent, and there would still be serious application problems. In order to obtain really permanent coatings, it is essential to be able to use polymers with a high molecular weight.

(9) The great disadvatage of the previously described hot film forming dispersions is that the film formation must be carried out at temperatures which are definitely above the MFT. In practice, there are often practical difficulties involved using polymers with as high a MFT as would actually be needed with consideration to the properties desired of the finished coating.

In practice, it is thus necessary to keep to polymers with a low MFT value, which involves comparatively soft polymers, often with insufficient physical, chemical and mechanical properties and, sometimes, a tendency towards sticking of painted surfaces. When coating surfaces according to the invention, however, there is no MFT limitation, since the film formation takes place with the aid of a solvent.

DESCRIPTION OF PREFERRED EMBODIMENTS

The following is a more detailed discussion of the requirements for the components of the dispersion employed according to the invention.

I. The Continuous Phase of the Dispersion

Generally the continuous phase is primarily water. However other volatile, inert fluids or mixtures of fluids can be used when desired.

II. The Main Bonding Agent

As discussed hereinabove, the main bonding agent is a polymer which can be dispersed in the continuous phase, and which, when the latter is driven off, forms solid particles with an appropriate grain size.

When applied at room temperature, the particles thereby obtained are to be comparatively hard, and the polymers should have an MFT>45° C. When desired, particles with a considerably higher MFT value can be used.

(a) Particle size

In general, the particles can have a size of from approx. 0.2 μm up to 20–30 μm. Particles with a diameter of 0.2–2 μm are preferred, and can be produced by efficient methods. When particles of a size of 0.2–2 μm are used, it is possible to produce thin coatings, which involves good economy. The sintering is also facilitated by small particles, since the exposed surface will be large and the polymers need not travel a long way in order to form a continuous coating. In pigmented systems, the particles and the pigment should be of approximately the same size, in order that a uniform distribution of pigment be obtained in the finished coating. Many pigments are just in the range of 0.2–2 μm. The maximum covering capability of pigment is at approx. 0.2–4 μm.

The upper limit for the particles diameter is thus determined, as mentioned above, primarily by the reduced possibilities of producing thin layers, reduced exposure speed when sintering with solvent, increased difficulty in achieving uniform distribution of the pigment.

Most of the factors are favourably influenced by small polymer particles. However, there is a practical lower limit, which is at approx. 0.2 μm. If the polymer particles are smaller, the temporary bonding agent will not be capable of fixing the particles and the powder layer will have insufficient strength before the exposure to solvent. The reduced effect of the temporary bonding agent as the diameter of the polymer particles is reduced can presumably be explained by the fact that a reduced polymer diameter gives a larger specific surface which, in turn, involves a reduced quantity of temporary bonding agent per surface unit polymer particles. When the size of the particles is small, there is also a tendency towards cracking in the layer of polymer particles.

In general, a uniform particle size gives a uniform coating of particles after the drying of the dispersion, and a uniform final coating. It is not always practical and economically possible to produce particles with little distribution of the particle size. This applies particularly to products based on certain functional monomers. It has also proved possible to mix in a certain quantity of polymer particles with a diameter which is distinctly below 0.2 μm, provided that the major portion of the polymer material is within the abovementioned limits.

In emulsion polymerization, the particle size is determined primarily by the type and quantity of emulsifier. The emulsifiers that can be used according to the invention can be of the non-ionic, anionic, cationic, or mixed ionic types. The emulsifiers must be adapted so that they do not pose any problems in combination with other components in the paint composition. Certain emulsifiers can also give poorer adhesion at the application of paint to non-absorbent bases such as metal and previously painted surfaces. The water resistance, water permeability and adhesion in the presence of water of the finished coat of paint is also influenced by the type and quantity of emulsifier. Certain emulsifiers such as special phosphate esters can also function as corrosion inhibitors. In accordance with the foregoing, the particle size is dependent on the type and quantity of emulsifier. However, the particle size cannot be treated as an independent variable, as the choice of emulsifier must be made with consideration taken of many other factors.

(b) Particle shape

In principle, the particles can have any geometrical form whatsoever. However, most of the polymers used are produced by means of emulsion or pearl polymerization, and the particles thus obtained have a spherical form, which usually is favorable. However, it is possible to use particles obtained in some other way, e.g. through precipitation polymerization, whereby the particles will have an irregular shape, or by means of grinding of granular and block polymers, whereby the particles will have an angular shape and will be of irregular size. It is also possible to use plastic scrap as the prime bonding material.

(c) Solubility of the particles

The particles are to be soluble, particularly in certain commonly available solvents. The solvents, as well as the method of obtaining solubility, will be dealt with in separate sections hereinbelow.

(d) Molecular weight

The molecular weight of the main bonding agent is to be more than 10,000, and for most of the polymers employed as the main bonding agent will be between 500,000 and one million, or more. A polymer with a lower molecular weight can often be used if there is pigment present in the system. This can have certain advantages, since a polymer with a low molecular weight will flow together better with the pigment, and thus permits a higher content of pigment.

(e) Chemical composition of the particles

In accordance with the foregoing, the particles are to have a certain hardness, e.g. indirectly expressed as MFT, solubility in solvent, and possibly also form. In principle, particles with these properties can have a very varying chemical composition. They can be produced e.g. through polymerization of unsaturated monomers such as methyl methacrylate or styrene, and they can consist of not cross-linked polyurethane, polyesters, polyamides, cellulose derivatives, such as cellulose nitrate, cellulose acetate and other cellulose esters or ethers.

In accordance with the foregoing, it is advantageous if the particles have a spherical shape; not too great a variation in the particle size if present, and a particle size particularly within the range of 0.2–2 μm. Such particles can most advantageously be produced by means of emulsion polymerization. This technique is usually based upon unsaturated monomers which can be polymerized. In the present-day situation as regards raw material, this is also the most interesting group of raw materials in the present connection. These monomers can give homopolymers of very varying hardness, from very soft polymers with Tg (glass formation temperature) down towards −70° C. up to hard polymers with Tg > 100° C. In general, these monomers are designated according to their properties, as softness promoting, medium hard and hardness promoting. There is no generally accepted classification, but the designations must be regarded as linguistic aids. If several different monomers are comprised in a system, the classification of each individual type of monomer will be dependent on its properties compared with the other types of monomers. Moreover, so-called functional monomers can be included.

Since the polymer particles in accordance with the foregoing are to be comparatively hard, the polymers can consist of a homopolymer of hardness promoting monomers such as polymethyl methacrylate or polystyrene. It can sometimes be justified to modify the properties through copolymerization with a medium hard or softness promoting monomer, e.g. in order to modify to an appropriate polymer hardness. When testing certain addition polymers, it has quite surprisingly been found that these have required a much shorter time of exposure to the solvent. Thus, a polymer based upon 90% methyl methacrylate and 10% butyl acrylate requires much shorter time of exposure than 100% polymethyl methacrylate.

The so-called functional monomers, e.g. methacrylic acid and other monomers with functional groups, can have different functions. They can, for instance, improve the mechanical stability of the polymer dispersion, which is of importance to the applicability. They can also improve the adhesion to bases, e.g. metal. They can also be utilized in order to give reactive, i.e. hardenable (cross-linked) polymers. Most often, only a few percent, sometimes in the order of 10% of the functional monomers are included. As previously mentioned, the corrosion inhibiting capability can also be influenced by the choice of monomers.

As an example of useful monomers, the following, commercially useful monomers may be mentioned. Most of them cannot be used as homopolymers, but only as co-monomers in various copolymers.

Vinyl aromatics, such as styrene, vinyl toluene and chlorostyrene. These are hardness promoting.

Vinyl halogenides such as vinyl chloride and vinylidene chloride. These are hardness promoting.

Vinyl cyanides, such as acrylonitrile and methacrylic nitrile. These are hardness promoting.

Vinyl esters, such as vinyl acetate (medium hard), vinyl propionate, vinyl laurate and vinyl esters of "Versatic acids", which are trade names of products from Shell. Softness promoting.

Non-cyclic hydrocarbon monomers of the alkene type, such as ethylene, propylene butadiene, isoprene, isobutene etc. Softness promoting.

Monomers based on esters of unsaturated acids, such as acrylic acid esters, e.g.
methylacrylate
ethyl acrylate butyl acrylate
hexyl acrylate
2-ethyl hexyl acrylate
octyl acrylate and higher esters, all in different isomer forms. These are softness promoting. The softening effect increases with an increased length of the alcohol part of the ester.

Methacrylic acid esters, e.g.
methyl methacrylate
ethyl methacrylate
propyl methacrylate
tertiary butyl methacrylate
isobutyl methacrylate
secondary butyl methacrylate
cyclic esters such as
benzyl methacrylate
phenyl methacrylate
cyclohexyl methacrylate
tetrahydrofurfuryl methacrylate All in this group are hardness promoting.

Butyl methacrylate, which is medium hard.
Hexyl methacrylate
2-ethyl hexyl methacrylate
octyl methacrylate and higher esters, all in different isomer forms.
Esters of glycol esters, such as
2-methoxy ethyl methacrylate
2-ethoxy ethyl methacrylate
2-methoxy butyl methacrylate All of these are softness promoting.

Corresponding esters of other acids that can be polymerized such as
α-chloro acrylic acid
itaconic acid
fumaric acid The above-mentioned monomers can be included in appropriate combinations as main monomers in polymers according to the invention. In accordance with the foregoing, it can also be justified to incorporate small quantities of so-called functional monomers. These monomers are often included to a content of 0.3–3 percent by weight, counted on the total monomer quantity, but in certain cases they can amount to 10–30 percent by weight. As an example of such monomers may be mentioned polymerizable acids, such as acrylic acid, methacrylic acid, itaconic acid, maleic acid, fumaric acid or monoesters of dibasic acids such as monobutyl itaconate and vinyl sulphonic acid, 2-sulphoethyl methacrylate and other mineral acid derivatives that are polymerizable.

Polymerizable amides, imides or substituted amides and imides of the above-mentioned or other acids, such as acrylic amide, methacrylic amide, dimethyl oxobutyl acrylic amide, N-vinyl succinimide, methylol amides such as N-methylol acrylic amide.

Hydroxy monomers such as hydroxy ethyl methacrylate or acrylate, hydroxy propyl methacrylate or acrylate, hydroxy butyl methacrylate or acrylate and other hydroxy derivatives of the above-mentioned polymerizable acids.

Through ring opening reactive monomers such as glycidyl methacrylate or acrylate, 2-aziridinyl ethyl methacrylate or acrylate.

Amino monomers such as N-dimethyl amino ethyl methacrylate or acrylate, N-diethyl amino ethyl methacrylate or acrylate, tertiary butyl amino ethyl methacrylate or acrylate, quarternary monomers, obtained e.g. through quarternarization of the amino esters as above.

Pyridine derivatives that are polymerizable, such as vinyl pyridine.

Acrylonitrile and other nitriles which, according to the foregoing, are classified as hardness promoting monomers, can also function as functional monomers.

Through the addition of ultra violet absorbing monomers, an ultra violet absorbing effect of the polymer can be obtained.

In accordance with the foregoing, the functional monomers can be utilized in order to achieve cross-linking of the surface coating. Such cross-linking is often desirable in order to obtain solvent resistance, increase the heat resistance, and in general to improve the physical and mechanical properties required of the final product. Such cross-linking can be achieved by a reactive group reacting with another group of the same kind, for instance an epoxy group from e.g. glycidyl methacrylate. This reaction is favored by catalysts. However, the most common way of achieving cross-linking is by having a reactive group react with a reactive group of a different kind, for instance, a carboxyl group from methacrylic acid reacts with an epoxy group from glycidyl methacrylate:

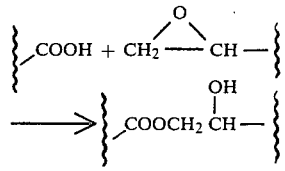

In accordance with the foregoing, cross-linking gives improved solvent resistance. However, a condition for the invention is that the polymer will be dissolved, in order to obtain film formation. Thus, cross-linking must not take place until after the treatment with solvent. If, for instance, methacrylic acid and glycidyl methacrylate are included in the same polymer particle, there is a risk for partial cross-linking We have found that premature cross-linking can be avoided by making two dispersions, one of them, for instance, containing methacrylic acid, and the other glycidyl methacrylate as functional monomers. The polymers are not cross-linked individually. Nor does cross-linking arise if the dispersions are mixed, as the reactive groups will not come into contact with each other.

A mixture of these particle dispersions can thus be applied to a surface and dried, and be exposed to solvent to form a coherent coating when the reactive groups come into contact with each other. Through heat activation, cross-linking can be obtained, whereby resistance to solvent and other effects according to the foregoing are achieved. Also other types of functional groups can be utilized in this way.

It is also possible to allow a functional group to be included in the hard polymer particles and another type of functional group to be included in the temporary bonding agent or added as a separate component.

It is also possible to cross-link e.g. ring-operating reactive groups by allowing a catalyst to participate in the exposure to solvent.

III. Temporary bonding agent (a) Quantity

Varying contents of the temporary bonding agent can be included, depending on the requirement for bonding capability. In general, a temporary bonding agent can be included amounts of 0.5–25 percent by volume, particularly 2–12 percent, based on the total quantity of dry substance. The lower limit is determined by the requirement for bonding capability. The upper limit is determined by several factors. As a rule, it is necessary that the dried layer is porous, so that the solvent can penetrate through the entire layer and make complete exposure possible. A very high content of temporary bonding agent reduces the porosity and thus reduces the possibility of obtaining complete exposure to solvent, particularly in the case of thick layers.

The temporary bonding agent can also be utilized to improve the impact strength. The quantity should then be greater than when it functions only as a temporary bonding agent.

(b) Hardness expressed as MFT

The temporary bonding agent should appropriately, but not necessarily consist of a polymer dispersion. Certain polymers which are soluble in water can also be used. These can also be used to a certain extent as consistency controlling agents or thickening agents. The best bonding agent effect is obtained if the bonding agent is comparatively soft and sticky. The MFT of the temporary bonding agent should moreover be well below the temperature that will prevail in the actual powder layer during the drying. This temperature can vary according to the invention. In general, the MFT should be at least 20° below the MFT for the main bonding agent.

(c) Particle size

If the temporary bonding agent is in a particle form, the particle size is essential for the function. For practical reasons, for instance from the point of view of production, however, it should be between 0.1–1 μm, and particularly between 0.05–0.5 μm. The particle size is determined to an essential extent by the type and quantity of the emulsifier included at the emulsion polymerization. This emulsifier can influence the composition of the paint and the final result. Thus, the particle size cannot be treated as an entirely independent variable.

(d) Ion activity

The particles can be of non-ionic, anionic, cationic or amphoteric character, or mixtures of these which can be used in practice. The particle charge must moreover be chosen with consideration to the charge of the main bonding agent, and with consideration to the charge of the other components of the composition, such as pigment, thickening agent etc. As regards the emulsifier that can be included in the temporary bonding agent, the same requirements and conditions as for the main bonding agent are applicable.

(e) Chemical composition of the temporary bonding agent

The types of polymers and monomers which have previously been described in connection with the main bonding agent can usually be used for the production of temporary bonding agent. However, the monomers must be chosen so that the MFT will be lower, i.e. the polymers are to be softer. This means that the so-called softness promoting monomers will dominate. So-called functional monomers, which have previously been described, can also be included, with the same functions as for the main bonding agent particles. Functional groups from the temporary bonding agent can also be chosen so that they can react with functional groups in the main bonding agent. As previously described, cross-linking can thereby be achieved, so that the final coating will have solvent resistance etc.

The chemical composition of the temporary bonding agent determines its combinability with the particles of the main bonding agent. In accordance with what is mentioned above, the combinability can be created with the aid of functional groups. Non-combinability can also be utilized for a positive purpose. The impact strength of hard and brittle polymers, e.g. polystyrene, can be improved through known technique by mixing in soft polymers, usually of the elastomer type. This principle can also be utilized here, as the temporary bonding agent obtains a double function, i.e. as temporary bonding agent and for improving the impact strength. In this case, it is advisable to use a larger quantity than when only the temporary bonding agent effect is desired.

As previously mentioned, the temporary bonding agent can be soluble in the continuous phase, and can be precipitated on the particles of the main bonding agent only in connection with the continuous phase being evaporated or driven off. As examples of such temporary bonding agents, which are soluble in water, and which can moreover serve as thickening agents and consistency controlling agents in the dispersion may be mentioned cellulose derivatives, water-soluble acrylic polymers etc.

IV. Pigments etc.

These components are optional, but in most cases, surface coatings are pigmented. In general, conventional pigments can be used, such as iron oxide, titanium dioxide, zinc oxide, zinc chromate, calcium carbonate, asbestos powder, talcum, etc. As in the case of conventional paints, pigments etc. sould be chosen in such a way that undesirable side effects in combination with other components are avoided. Also positive side effects are possible, such as ion cross-linking of the polymer with the aid of zinc. If abrasive grains are used, abrasive paper, grinding wheels, anti-skid coatings and the like can be produced. Grains of e.g. potassium chlorate, calcium perchlorate, and certain powder-formed nitro compounds can give initiating explosives, initiating compositions for e.g. matches, and other pyrotechnically useful products etc.

The pigment content should not be altogether too high, and as a rule, the total content of bonding agent in the actual layer should not be less than 40 percent by volume. On the other hand, there is nothing to prevent somewhat larger grains being mixed in, which will then only be partly embedded in the finished layer of bonding agent. Only the portion of these larger grains that is embedded in the layer of bonding agent are then to be considered to be included in the actual ballast. Such coarse grains can be used for decorative purposes, as abrasives, and as e.g. ignition compositions for matches.

In conventional paint for indoor use, the concentration of pigment volume is approx. 50%, and in conventional paint intended for outdoor use it is approx. 30–35%, and for bright lacquer approx. 20%.

In the procedure according to the invention, we have found that the main bonding agent plus the temporary bonding agent should constitute at least 40% of the total dry substance, and out of this 40%, the temporary bonding agent should not constitute more than 25%. The total content of pigment etc. must thus not exceed 60% of the dry substance.

V. Other additives

Additives for pigment dispersion and for control of viscosity, thixotropy, surface flowing etc. can be of the type normally used in emulsion paints. These additives should be chosen so that undesirable side effects in combination with other components are avoided. It is also possible to achieve positive effects in combination with other components. Functional groups in the thickening agent can, for instance, react with functional groups in the powder-formed material and/or the temporary bonding agent. Cross-linking and improvement of the final product can thereby be obtained. In the same way, the detrimental effect on the water proofness and increase of water absorption that can be caused by thickening agent, pigment dispersion agent etc. can be eliminated or reduced. As an example of other additives may be mentioned foam reducers and ultra violet absorption agents, as well as adhesion improving agents.

Application on Surface to Be Coated

The composition can be applied on the surface which is to be treated with the aid of conventional methods, such as the use of brushes, rollers, spray painting, high pressure spraying (airless), curtain coating, flushing and dipping. Different bases can require different kinds of equipment. The bases may have flat, bent or irregular surfaces. Also cavities, such as inner walls of tubes can be treated. Mineral grains, powder and other granular material can also be treated. The method can also be applied at the manufacture of macroporous coatings or bodies such as mould cores, grinding wheels etc. Wire and strip lacquering is particularly well suited for continuous processes. The method can also be used for marking of roads. The bases can consist of e.g. paper, boards, plastic, rubber, textiles, wood, metal, cement and concrete products, including asbestos cement, glass, lime, marble and other natural stone. It can sometimes be advisable to have the base pretreated with an appropriate priming paint, for instance to order to achieve rust protection or improved adhesion.

The temperature of the base can vary, according to the type and the conditions. The method according to the invention is not strictly dependent on the temperature of the base. At low temperatures, however, the drying time may be long, and the drying might possibly not be complete. These factors limit the practical lower temperature limit. Altogether too high temperature of the base can give rise to blistering in the coating. The drying can also be accelerated with the aid of air circulation, appropriately hot air. Rapid drying is particularly important for continuous coatings in factory-scale production. The temperature in the actual coat of paint must be adapted to the paint composition and vice versa. The MFT value of the main bonding agent should be 20° above, and the MFT value of the temporary bonding agent should be below the temperature prevailing in the actual coating during the drying.

Film Formation with the Aid of Solvent

The final film formation of the polymer particles is achieved according to the invention with the aid of solvent, or a combination of solvent and heat. The condition for film formation is, of course, that the solvent or solvent mixture can dissolve or swell the particles at the exposure temperature used so that the particles can flow together and form a continuous surface coating. The dissolving capability increases as the temperature is increased. A solvent can thus have insufficient dissolving capability at room temperature, but sufficient effect at some ten degrees higher temperature. The exposure can take place with the solvent in a gaseous or liquid form, according to several methods, such as dipping, spraying, curtain coating, application with a brush, gas treatment in a vapour phase over a boiling solvent, gas treatment with the aid of air or other gas as a carrier. It is also possible to dissolve a polymer or other polyfunctional additives in the solvent, in order to control the viscosity and so that these can have a positive effect on the final surface coating. The polymer can contain e.g. reactive groups, which can react with other reactive groups in the coating, thereby achieving cross-linking etc.

Treatment with solvent can be carried out with the aid of a number of different technical arrangements, for instance for the purpose of optimizing the economy of the process, such as heat economy and recovery of solvent. The process can be arranged for both stationary and portable use. The treatment can most easily be carried out at atmospheric pressure, but can also be carried out at a higher or a lower pressure. Vapourized solvent can for instance be fed in a device similar to the existing trichloroethylene degreasing equipment, the coated treatment then being kept dipped into the solvent vapour in the upper part of the apparatus. It is also possible to blow solvent vapour on to the surface via an inner tube, and via an outer, concentric tube to suck up the excess solvent, which can thereafter be condensed and/or reused.

A great number of different solvents can be used according to the invention. The boiling point can vary within wide limits, depending upon the technique used, the type of polymer etc. Solvents with an altogether too low boiling point are more difficult to condense, and involve stringent requirements for the recovery part, in order to keep the losses down. A high boiling point involves e.g. a high exposure temperature, and delays the drying. As a rule, a high boiling point can be justified only when special solvents are required for the polymer. There are thus practical limits for both the lowest and the highest boiling points of the solvents. In general, the boiling point can vary between 0° and 300° C. but in most practical cases the limits are between 20° and 140° C., particularly 35°–120° C. Consideration must also be taken to the toxicity of the solvent, its flammability, explosion limits, corrosiveness, stability, and possible reactivity with functional groups in the polymers etc.

Specification of solvents (with boiling points) that can be used according to the invention:

| Examples of alcohols | b.p. in °C. |
|---|---|
| Methanol | 64.8 |
| Ethanol | 78.3 |
| n-propanol | 82.3 |
| Isopropanol | 97.3 |
| n-butanol | 117.7 |
| Secondary butanol | 98.8 |
| Isobutanol | 108.3 |
| Tertiary butanol | 82.8 |
| Amyl alcohols of various isomer compositions | approx. 110–140 |
| Furfuryl alcohol | 171 |
| Tetrahydrofurfuryl alcohol | 177 |
| Cyclohexanol | 161 |
| Benzyl alcohol | 205 |

Of the above, ethanol and isopropanol are the most interesting solvents, due to their solubility properties, boiling points, price and comparatively low toxicity.

| Examples of ether alcohols | b.p. in °C. |
|---|---|
| 2-methoxyethanol | 124.5 |
| 2-ethoxy ethanol | 135.6 |
| 2-propoxy ethanol | 150 |
| 2-butoxy ethanol | 171.1 |
| 2-isobutyl ethanol | 160 |
| 2-methoxy butanol | |
| 1-ethoxy-2-propanol | 132.2 |
| 1-(2-ethoxy-ethoxy) ethanol | 202.8 |

2-ethoxy ethanol is most useful, due to its solubility properties, boiling point, price and comparatively low toxicity.

| Examples of ketones | b.p. in °C. |
|---|---|
| Acetone | 56.2 |
| Methyl ethyl ketone | 79.6 |
| Methyl-n-propyl ketone | 102.0 |
| Diethyl ketone | 102.8 |
| Methyl isobutyl ketone | 115.1 |
| Methyl-n-butyl ketone | 122.8 |
| Ethyl-n-butyl ketone | 147.6 |
| Diacetone alcohol | 169.2 |
| Cyclohexanone | 155.4 |
| Isophorone | 215.2 |
| Diisobutyl ketone | 169.3 |
| Acetyl acetone | 140.4 |

Acetone and methyl ethyl ketone are particularly useful, due to their solubility properties, boiling points and price.

Examples of Ethers

Most ethers can form peroxides, and have a low spontaneous ignition temperature and sometimes an anaesthetic effect, which to a high degree limits their use.

| | b.p. in °C. |
|---|---|
| Diethyl ether | 34.5 |
| Diisopropyl ether | 68.3 |
| 1,2-diethoxy ethane | 121.1 |
| Tetrahydrofuran | 65.4 |
| Dioxan | 101.3 |

Examples of Esters

| | |
|---|---|
| Methyl acetate | 57.2 |
| Ethyl acetate | 76.7 |
| n-propyl acetate | 101.6 |
| Isopropyl acetate | 88.7 |
| n-butyl acetate | 126.6 |
| Secondary butyl acetate | 112.2 |
| Isobutyl acetate | 116.4 |
| Amyl acetate, various isomers | 110–150 |
| Ethyl propionate | 99.1 |
| 2-ethoxy ethyl acetate | 156.4 |
| Ethylene carbonate | 248 (non-stable) |
| Propylene carbonate | 242.1 |
| Vinyl acetate | 72 |
| Vinyl propionate | |
| Methyl methacrylate | 100.1 |
| Ethyl methacrylate | 114.1 |
| Butyl methacrylate | 142.2 |
| 2-ethoxy ethyl methacrylate | 180 approx. |
| 1,4-butandiol methacrylate | 260–265 |

Esters, particularly those with comparatively low boiling points, are generally seen good solvents. Ethyl acetate and ispropyl acetate are the most interesting ones, with consideration to their solubility properties, boiling points and prices. The unsaturated types, i.e. the vinyl esters and the methacrylates, can be polymerized, which involves that they can be caused to polymerize in the actual surface coating.

Examples of Hydrocarbons

Pure alkanes such as n-hexane—68.7 and n-heptane'98.4 are usually insufficient as the only solvent.

| | b.p. in °C. | |
|---|---|---|
| Cyclohexane | 80.7 | |
| Benzene | 80.1 | (good solvent, but poisonous) |
| Toluene | 110.6 | |
| Xylene | 140 | |
| Ethyl benzene | 136.2 | |
| Styrene | 146 | |
| Vinyl toluene | 172 | |

Due to their solubility properties, price and toxicity, cyclohexane and toluene are most useful. Styrene and vinyl toluene can also be polymerized, and can thus be caused to polymerize in the actual surface coating.

Examples of Halogenated Solvents

These are often uninflammable or difficult to cause to burn, which is often a great advantage. Halogen hydrogen can be separated off under certain conditions, to which due consideration must be taken.

| | b.p. in °C. |
|---|---|
| Ethyl chloride | 12.3 |
| Butyl chloride | 78.8 |
| Methylene chloride | 39.8 |
| 1,2-dichloroethane | 83.5 |
| 1,1,2-trichloroethane | 113.7 |
| Chloroform | 61.7 |
| Trichloroethylene | 87.1 |
| Carbon tetrachloride | 76.5 |
| Perchloroethylene | 121.2 |
| Methyl chloroform | 74 |
| Chlorobenzene | 132.0 |
| Chlorotoluene | 159.2 |
| Trichlorofluoro methane (Freon 11) | 23.8 |
| 1,1,2-trifluoro-1,2,2-Trichloroethane (Freon 113) | 47.6 |
| Sym-tetrachloride fluoroethane (Freon 112) | 92 |

Methylene chloride, trichloroethylene, methyl chloroform and perchloroethylene are generally the most useful and also the most appropriate solvents.

Examples of Other Solvents

| | |
|---|---|
| Acetone nitrile | 72.8 |
| Dimethyl formamide | 152.8 |
| Dimethyl sulphoxide | |
| Pyridine | 115.5 |
| 1-nitro propane | 131.6 |
| 2-nitro propane | 120.3 |
| Acetic acid | 117.9 |
| Diacetone acrylic amide (can be polymerized) | 120 (8 mm) |
| Tetramethylene sulphone | |

-continued

| | |
|---|---|
| (Sulfolane) | 282–288 |

Mixtures of different solvents can also be used. Azeotropes of different solvents are particularly useful. The following examples can be given of some appropriate combinations of solvents.

| | |
|---|---|
| 69% ethyl acetate<br>31% ethanol | b.p. = 71.8° C. |
| 91.8% ethyl acetate<br>8.2% water | b.p. = 70.4° C. |
| 68% ethanol<br>32% toluene | b.p. = 76.7° C. |

Drying of the Coating

The drying should appropriately be carried out directly in connection with the treatment with solvent. Previous heating can than be utilized, and it also facilitates the recovery of solvent. The drying temperature is to a high degree dependent on the boiling point of the solvent, and it is also dependent on the capability of the coating to retain the solvent. The use of volatile solvents facilitates the drying, which should appropriately be carried out with the aid of circulating hot air. The recovery of solvent can, for instance, take place through condensation in a cooler or adsorption in a regeneratable mass such as active carbon or polymer adsorbents.

Cross-linking or Hardening of the Coating

This hardening should appropriately take place directly in connection with the hardening. The hardening usually requires a temperature of 100°–175° C., sometimes lower at reactive systems, but also higher temperatures can occur. In this special case, it is thus a question of a heating of a material that has already formed a film.

The invention will be described in more detail in connection with the following examples, and is defined in the accompanying claims.

EXAMPLE 1

A mixture was made of two dispersions, one of them containing 40% hard particles in water (main bonding agent) and the other containing 45% soft particles in water (temporary bonding agent). The quantity of temporary bonding agent constituted 5% of the dry volume of the mixture. The main bonding agent was made through a 5-stage emulsion polymerization containing the following substances:

| | | |
|---|---|---|
| Monomer: | methyl metacrylate | 800 parts |
| Emulsifier: | polyoxyethylene monolaurate[x] | 24 parts |
| Initiator: | ammonium persulfate | 1 part |
| Concentrated ammonia solution | | 3 parts |
| Continuous phase: Distilled water | | 1025 parts |

[x]Tween 20 from Atlas

The particles were monodisperse, with a diameter of 0.40 μm. The molecular weight=mean value of 1,000,000 weights determined with gel permeation chromatography.

The temporary bonding agent was made through a 4-stage emulsion polymerization, as follows:

| | | Parts by weight |
|---|---|---|
| Monomer: | ethyl acrylate 98% | 490 |
| | methacrylic acid 2% | 10 |
| Emulsifier: | phosphate tenside of anion + non-ion type[xx] | 25 (40%) |
| Initiator: | potassium persulfate | 1 |
| Continuous phase: Distilled water | | 600 |

The particle size was diameter 0.2 μm.

[xx]Berol 733 from Berol Kemi AB

The mixture was applied with a brush on a sheet of eternite, and the quantity was chosen so that, when dried and exposed to the solvent, the coating would have a thickness of 40 μm.

The coating was allowed to dry in room temperature for 5 hours, after which a white, coherent, smooth coating of powder, free from cracks remained. This adhered well to the base (see example 2).

In an apparatus consisting of a long, narrow, upright metal vessel with a cooling jacket at the top and a wide bottom, placed on a heating plate, acetone was heated at the bottom (see figure). The volume of the vessel was then filled above an approx. 100 mm thick boiling layer of liquid in the bottom and under the cooling jacket with saturated acetone vapour at the boiling point (=56°) of the acetone. The sheet of eternite with the powder coating was dipped down into this solvent vapour (but not down into the boiling layer of liquid) for 10 secs. Immediately after this treatment, the surface coating consisted of a non-sticky transparent polymer film. During 10 minutes in room temperature, almost all of the retained quantity of acetone was emitted, so that after this time, 10% acetone, counted on the weight of the polymer, was dissolved in the coating. The remaining acetone was removed by drying in a heating chamber at 50° during 30 minutes. The coating obtained was hard, transparent, adhered well to the base, and had a smooth surface, free from cracks, with a high lustre.

EXAMPLE 2

Mixtures were made of two dispersions, with a dispersion with main bonding agent according to example 1. The dispersion with the temporary bonding agent will be noted from the table. Thus, 100 parts of the dispersion mixture with a dry content=40% and with a ratio of soft/hard particles=5/95, with 67 parts thickening solution resulting in a paint composition with 35% dry content.

The thickening solution consisted of:

0.85% high-molecular hydroxy-ethyl cellulose[x]
0.5% anti-foam agent of type silicone emulsion[xx]
99.1% distilled water

[x]Natrosol HH 250
[xx]H:10 from Dow

The paint was sprayed on eternite sheets with a membrane sprayer to a quantity corresponding to a coating with a thickness of 40 μm in exposed condition. The sheets were thereafter allowed to dry in room temperature for 5 hours.

In order to determine the resistance of the powder coated but not solution-treated sheets to damage to the powder coating, the wear strength was measured on them. The measurements were carried out in accordance with SIS 184165, with the exception of two items:

(1) eternite sheets, not steel plate
(2) 200 g of sand, not 4 kg in each charge.

The results will be noted from the table. The calculated glass temperature for the polymers is indicated in the table. This has been calculated according to the formula:

$$\frac{1}{Tg} = \frac{m_1}{Tg_1} + \frac{m_2}{Tg_2} + \frac{m_n}{Tg_n}$$

in which $Tg_1$ etc. is the glass temperature for each of the homopolymers and $m_1$ etc. is the content of each monomer. Further, the calculated minimum film-formation temperature is given, in cases where it has been possible to determine this experimentally. For one and the same polymer, the minimum film-formation temperature (MFT) is 7°–10° C. above its glass temperature.

| Dry percent by volume of temporary bonding agent | kg sand/μm layer thickness |
|---|---|
| 0 | 0.004 |
| 0.5 | 0.008 |
| 1 | 0.012 |
| 2 | 0.021 |
| 3 | 0.033 |
| 4 | 0.052 |
| 5 | 0.070 |
| 6 | 0.093 |
| 8 | 0.190 |
| 30 | more than 0.25 |

| | Monomers included | | | | | Calculated | | Kg sand |
|---|---|---|---|---|---|---|---|---|
| | Methyl metacrylate | Ethyl acrylate | Methacrylic acid | Other monomers | Emulsifier included | glass temp. Tg | Measured MFT | thickness of coating μm |
| A | — | — | 2 | 2-ethyl-hexyl acrylate 98 | Anionic | −52 | (cannot be measured) | 0.028 |
| B | — | — | 1 | Butyl acrylate 99 | Non-ionic | −44 | (cannot be measured) | 0.024 |
| C | — | 98 | 2 | — | Berol 733 phosphate tenside | −20 | (cannot be (measured) | 0.050 |
| D | 45 | 53.5 | 1.5 | — | Berol 733 phosphate tenside | | 20 | 0.012 |
| E | 56 | 42 | 2 | — | Anion tenside + non-ion tenside | | 32 | 0.010 |

As will be noted from the table, at the drying temperature (25°) the temporary bonding agent with MFT had a distinctly greater capability of keeping the powder particles together. Further, temporary bonding agent based on ethyl acrylate was definitely better than the others. All of the coatings were exposed to acetone according to example 1. However, the coatings with MFT 20 and 32° were very sensitive to damage to the coating before the treatment with the solution. The coatings, exposed and subsequently dried according to example 1 were transparent, hard, smooth, adhered well to the base, and had a high lustre.

EXAMPLE 3

Mixtures of dispersions according to example 1 were made with different contents of temporary bonding agent. 100 parts of each of these mixtures were thickened through the addition of thickening agent, of the type alkali-soluble acrylic dispersion with co-polymer between ethyl acrylate and methacrylic acid[x], 1 part per 100 parts of dispersion and with pH adjustment with concentrated ammonia solution to final pH 9.

[x]Rohagit SD-15 from Röhm

These formulas were applied with a brush to sheets of eternite in a quantity corresponding to a dried, exposed coating with a thickness of 40 μm. The drying took place for 5 hours at room temperature. In order to determine how much temporary bonding agent is required in order to fasten the powder dispersion to the base before the solvent treatment, dry-wear tests were made according to example 2. See table:

It should be noted that the quantity of thickening agent for all of the temporary bonding agent contents is at 1 percent by volume of the dry content. We have found that also the thickening agent functions as a temporary bonding agent, and that its quantity should be added to the quantity of temporary bonding agent, in order to obtain a correct value of the total quantity of film-forming polymer, active as bonding agent for the hard-polymer particles.

Attempts to apply unthickened main bonding agent dispersion were made, but the results were all negative.

As will be noted, the temporary bonding agent has effect even in very small quantities. Further, the resistance to wear increases constantly as the quantity of temporary bonding agent is increased, at least up to 30% of this.

At a comparison for 5% temporary bonding agent with example 2, it was found that application with a brush gave a higher value than spraying.

Exposure to acetone vapour took place according to example 1. The result was transparent, hard and smooth coatings with a high lustre, except the sample with 30% temporary bonding agent. In this case, a coating was obtained which had a film formed and was smooth on the surface, but farther down in the coating consisted of unexposed particles. The mechanism with solvent vapour which diffuses into the base through the coating and condenses against the base, and from there and out towards the air surface exposes the film, did not function in this case, as it was not a question of a porous coating, but particles in a homogeneous phase of film-formed polymer.

EXAMPLE 4

Mixtures of dispersions and formulas of unpigmented paint according to example 2.

Application on sheets of eternite with a temperature of 55° C. to a quantity corresponding to a dried and exposed coating with a thickness of 40 μm. The drying took place in a heating chamber at 55° C. during 2 hours. Test of wear resistance according to method as per example 2. Results:

| | Monomers | Calculated Tg | MFT | kg sand/μm coating thickness |
|---|---|---|---|---|
| A | 2-EHA/MAS | −52 | | 0.030 |
| B | BA/MAS | −44 | | 0.020 |
| C | EA/MAS | −20 | | 0.050 |
| D | MMA/EA/MAS | | 20 | 0.030 |
| E | MMA/EA/MAS | | 32 | 0.030 |

-continued (4) Thickening solution according to example 2.

[x]Dispersol T from ICI
[xx]H:10 according to example 2
[xxx]Benton EW from Kronos Titan AB The contents of the four components will be noted from the table. The paint was sprayed on sheets of eternite to a quantity corresponding to a dried and exposed coating with a thickness of 40 μm. The drying took place at room temperature. The wear resistance was measured according to example 2, see table. In the table, the expression CPV is indicated, which denotes the volume concentration of pigment in the dried and exposed paint (concentration of pigment volume). There is also the expression CTBV, which hereinafter refers to the volume concentration of temporary bonding agent in the dried and exposed paint (concentration of temporary bonding agent volume).

| Main bonding agent 40% dispersion parts by weight | Temporary bonding agent parts by weight 40% dispersion | CTBV | Pigment paste parts by weight paste | CPV | Thickening solution | Other components | kg sand per μm coat thickness |
|---|---|---|---|---|---|---|---|
| 100 | 4.7 | 5 | 0 | 0 | 67 | — | 0.070 |
| 100 | 6.2 | 5 | 54 | 15 | 80 | — | 0.033 |
| 100 | 6.6 | 5 | 76 | 20 | 88 | — | 0.028 |
| 50 | 3.10 | 5 | 51 | 25 | 40 | distilled water 9 | 0.022 |
| 50 | 3.4 | 5 | 65.5 | 30 | 35 | distilled water 19 | 0.013 |
| 25 | 2.0 | 10 | 38 | 40 | 15 | distilled water 10 | 0.13 |
| 25 | 2.4 | 10 | 51 | 50 | 15 | distilled water 20 | 0.09 |

As will be noted from the table, the differences in wear resistance are considerably less than as per example 2. It can also be noted that the hardest temporary bonding agents, which did not function at 25° drying temperature, could now be used at an elevated drying temperature.

The exposure of the sheets was carried out with the apparatus according to example 1. Methylene chloride vapour at the boiling point (54°) of methylene chloride was used as a solvent. Exposure time = 10 seconds. The coatings obtained adhered well to the base, had a high lustre, were transparent, and hard and smooth.

EXAMPLE 5

Paint formulas were made with four components, as follows:

| | | | |
|---|---|---|---|
| (1) Dispersion with main bonding agent according to example 1 | | | |
| (2) Dispersion with temporary bonding agent with the composition | ethyl acrylate | 98% | 980 |
| | methacrylic acid | 2% | 20 |
| | sodium lauryl sulphate | | 20 |
| | distilled water | | 980 |
| | trisodium phosphate | | 4 |

(3) Pigment paste with black iron oxide, as follows:

| | Parts by weight |
|---|---|
| $Fe_3O_4$ pigment | 350 |
| distilled water | 250 |
| dispersion agent[x] 5% | 45 |
| anti-foam agent[xx] 50% | 1 |
| thickening agent[xxx] | 5 |
| | 651 |

Through the increasing content of temporary bonding agent, such a high content of pigment as 50 CPV could give a powder coating that adhered well to the base. The exposion to solvent took place in an apparatus according to example 1, with acetone vapor. Owing to the increasing content of non-fluid materials as the CPV increased, longer exposure times were required, as follows:

| CPV | number of seconds in 56° acetone vapour |
|---|---|
| 0 | 10 |
| 15 | 10 |
| 20 | 15 |
| 25 | 15 |
| 30 | 20 |
| 40 | 25 |
| 50 | 30 |

The after-drying took place in a heating chamber at 50° for 30 minutes. The coatings obtained were smooth, hard and adhered well to the base. The lustre decreased as the CPV increased.

By removing the outermost layer of pigment which was not entirely imbedded in the polymer, a higher lustre was obtained also on the sheets with 40 50 CPV. These highly pigmented plates proved to be excellent for use as "blackboards" i.e. to write on with chalk and to erase with a cloth time and again. They were moreover guaranteed not to give any screechy scraping sound.

EXAMPLE 6

An acrylic dispersion made according to 4-stage emulsion polymerization, with the following composition:

| | | parts by weight | |
|---|---|---|---|
| methyl methacrylate | 35% | 280 | |
| butyl acrylate | 50% | 400 | |
| methacrylic acid | 15% | 120 | |
| tertiary dodecyl mercaptan | | 4.4 | (90%) |
| sodium lauryl sulphate | | 8 | |
| potassium persulphate | | 5 | |
| sodium persulphite | | 2.5 | |
| distilled water | | 1200 | |

the particle size was 0.2 μ

The pH of the dispersion was adjusted to pH=9, while water was added at the same time, so that a water solution with a high viscosity and 18% dry content was obtained. This solution was subsequently utilized for two functions: as a temporary bonding agent and as a thickener.

This took place through the addition to the main bonding agent dispersion according to example 1 to a quantity corresponding to 10% of the dry volume. The mixture obtained was applied with a brush on a wooden sheet to a thickness corresponding to a dried and exposed coating with a thickness of 25 μm.

The sheet was dried in room temperature. The powder coating obtained adhered well to the base. The solvent treatment took place by blowing through a nozzle 10–30 mm from the surface of the powder, and at right angles to this, a gas mixture consisting of azeotrope between ethyl acetate and ethanol (ratio 69/31) and nitrogen gas. This gas mixture was obtained by bubbling nitrogen gas through boiling liquid of ethyl acetate/ethanol with a ratio of 69/31. In this example, the temperature of the gas mixture was equal to the boiling point of the azeotrope=72°. Further, the ratio of nitrogen gas/solvent vapour in this case=1/1.

After the exposure, a hard, transparent film coating was obtained on the wooden sheet.

EXAMPLE 7

A mixture was made of a temporary bonding agent according to example 1 (45% water dispersion) and a dispersion with hard, small particles, so that the temporary bonding agent constituted 10% of the dry volume. The powder dispersion was made through emulsion polymerization in 5 stages, as follows:

| | parts by weight | |
|---|---|---|
| methyl methacrylate | 980 | |
| methacrylic acid | 20 | |
| Berol 755 phosphate emulsifier | 50 | (40%) |
| Potassium persulphate | 2 | |
| Distilled water | 1200 | |

The particle size was 0.18 μm, determined through extinction measuring. This method of determining the particle size takes very great consideration to the large particles in the system, according to the mean diameter=

$$\epsilon ni\ Di^5/\epsilon ni\ Di^4$$

in which ni=the number of particles with the diameter Di. The molecular weight was approx. 800,000. The mixture was thickened with a thickening agent of the polyurethane type[x] of which was added 2 parts 10% solution per 100 parts dispersion mixture with 40% dry content.

[x]Verdickungsmittel D from Bayer

The paint was applied with a brush on a steel plate to a thickness corresponding to a 30 μm dried and exposed coating. The drying took place in room temperature during 5 hours. The solution treatment took place by the acetone, thickened with 1% high-molecular polymethyl methacrylate being sprayed with a membrane sprayer to a very thin coating. After 5 minutes in room temperature, the remaining solvent was dried off in a heating chamber at 60° during 30 minutes. A transparent, smooth, and well adhering coating was obtained. No indication whatsoever of rust could be found on the sheet of steel under the coating. This is presumably thanks to the fact that the dispersion with main bonding agent contained a phosphate emulsifier with a corrosion-inhibiting effect.

EXAMPLE 8

A mixture of the dispersion containing temporary bonding agent according to example 1 to 8% of the dry volume in the mixture and a dispersion containing main bonding agent was made. The latter dispersion was made through a 5-stage emulsion polymerization with the following components:

| | parts by weight |
|---|---|
| Methyl methacrylate | 800 |
| Lauric acid | 6,4 |
| Ammonium persulphate | 1 |
| Concentrated $NH_4$ solution | 12.5 |
| Distilled water | 1180 |

The particle size was 0.30 μm of monodisperse particles. Thickening took place with an acrylic thickener according to example 3. The paint was applied with a brush on a sheet of glass to a thickness corresponding to 50 μm dried and exposed coating. The sheet was dried in a 50° heating chamber for 4 hours. The treatment with solvent took place with the apparatus according to example 1, with methylene ketone at its boiling point (79.6° C.) during 20 seconds. A hard, transparent, high-gloss coating was obtained.

EXAMPLE 9

5% of the dry volume of the temporary bonding agent dispersion according to example 1 was mixed with a main bonding agent dispersion with 40% dry content and particles with a size of 0.6 μm. This dispersion was made through a 2-stage emulsion polymerization, with the following components:

| | parts by weight |
|---|---|
| Methyl methacrylate | 712 |
| Tween 20 (see Example 1) | 21.4 |
| Ammonium persulphate | 0.55 |
| Concentrated ammonia solution | 0.6 |

The mixture was thickened and applied on a sheet of glass as per example 8. The thickness corresponded to a 90 μm dried, exposed coating. The drying took place as per example 8. The solvent treatment took place during 30 seconds according to example 8. After-drying according to example 8. A thick, uniform, glossy, transparent coating was obtained.

EXAMPLE 10

A mixture of 5% on the dry volume of a temporary bonding agent in dispersion with a dry content of 40% and a powder suspended in water with a particle size of approx. 15 μm was made. The temporary bonding agent was made through emulsion polymerization with the following components:

| | parts by weight |
|---|---|
| Ethyl acrylate 93% | 744 |
| Methacrylic acid 7% | 56 |
| Non-ionic emulsifier* | 18 |
| Potassium persulphate | 4 |
| Sodium Pyrosulphite | 2 |
| Distilled water | 1200 |

*Berol 09 from Berol Kemi AB

The powder was made through pearl polymerization of styrene. The temporary bonding agent was also allowed to function as a thickening agent, by the pH being increased to 9 with concentrated ammonia solution. The mixture was applied with a brush on a base of eternite, to a thickness corresponding to 60 μm dried, exposed coating. The drying took place in 60° in a heating chamber during 2 hours. The solution treatment took place with methylene chloride in a liquid form, thickened with 1% high-molecular polymethyl methacrylate. This solution was applied with a brush at room temperature to a thin coating. After 20 minutes in room temperature, a transparent coating was obtained, which was after-dried in room temperature for 2 hours. The final coating was hard, smooth, and adhered well to the base.

EXAMPLE 11

A mixture of 2% counted on the dry volume of temporary bonding agent according to example 1 and a 50% water suspension of polymethyl methacrylate particles with a quantity mean value of approx. 20 μm diameter, but with a considerable quantity of particles up to 50μ and occasional particles up to 80μ. Thickening took place according to example 3. Application with a brush on eternite, to a thickness corresponding to 100μ dried, exposed coating. Drying in 60° heating chamber. After cooling to room temperature, 1,1,1-tricholorethane thickened with 2% high molecule copolymer between 70% methyl methacrylate and 30% butyl acrylate was applied with a brush. After 10 minutes in room temperature, the sheet was placed in a 70° heating chamber for 2 hours. A thick, smooth, transparent coating was obtained.

EXAMPLE 12

Mixtures of the dispersion with temporary bonding agent according to example 1 to 5% counted on the dry volume and dispersions containing main bonding agent were made. The main bonding agents were according to example 1 (1) as well as a copolymer with 70% methyl methacrylate and 30% butyl acrylate (2). The latter main bonding agents have the same particle size, and were made identical to (1).

Thickening took place according to example 3. The paints were applied with a brush on eternite sheets to a thickness corresponding to 40 μm. Drying took place in room temperature during 5 hours. The solvent treatment took place in an apparatus according to example 1.

Solvents, exposure times and results according to the table. As will be noted from the table, solvents must be chosen according to the monomer composition of the polymer. The exposure time must be chosen with consideration taken to both the solvent and the monomer composition of the polymer. A "too rapid" solvent dissolves the polymer altogther too rapidly at its boiling point, which gives a sealing of the surface, through which the further solvent vapor required can only penetrate very slowly, in the form of condensed liquid. A "too slow" solvent dissolves the polymer from the surface of the base and outwards, but the particle sintering goes so slowly, that the surface has a tendency to become dull.

| Solvent | Temp. at exposure =b.p. of solvent | Exposure time seconds | Powder Powder | Appearance | Comments |
|---|---|---|---|---|---|
| Ethanol | 78.3 | 10 | 1 | Dull | |
| | | 10 | 2 | Good | |
| Isopropanol | 97.3 | 15 | 1 | Not exposed through | Too slow |
| | | 15 | 2 | Good | |
| Acetone | 56.2 | 10 | 1 | Good | |
| | | 10 | 2 | Surface sealed | Too rapid |
| Methyl-ethyl ketone | 79.6 | 10 | 1 | Good | |
| | | 10 | 2 | Good | |
| Methyl-isobutyl ketone | 115.1 | 15 | 1 | Not exposed through | Too slow |
| | | 10 | 2 | Good | |
| Ethyl acetate | 76.7 | 5 | 1 | Dull | |
| | | 5 | 2 | Good | |
| Trichloroethylene | 87.1 | 5 | 1 | Good | |
| | | 5 | 2 | Good | |
| Ethyl acetate/Ethanol in proportion 69/31 | 71.8 | 5 | 1 | Good | |
| | | 5 | 2 | Good | |
| Ethanol/Toluene | 76.7 | 10 | 1 | Not exposed through | Too slow |
| | | 10 | 2 | Good | |
| Methyl-ethyl ketone in $\frac{66}{34}$ Ethanol | 74.8 | 10 | 1 | Good | |
| | | 10 | 2 | Surface sealed | Too rapid |
| Cyclohexane in $\frac{67}{33}$ Isopropanol | 68.6 | 10 | 1 | Not exposed through | Too slow |
| | | 10 | 2 | Good | |
| Cyclohexane in $\frac{33}{67}$ Acetone | 53 | 10 | 1 | Not exposed through | Too slow |
| | | 10 | 2 | Good | |

-continued

| Solvent | Temp. at exposure =b.p. of solvent | Exposure time seconds | Powder Powder | Appearance | Comments |
|---|---|---|---|---|---|
| n-propyl- | 101.6 | 10 | 1 | Not exposed through | Too slow |
| acetate | | 10 | 2 | Good | |
| n-butyl- | 126.6 | 10 | 1 | Not exposed through | Too slow |
| acetate | | 10 | 2 | Good | (slow) |
| Cyclohexane | 80.7 | 10 | 1 | Not exposed | Too slow |
| | | 10 | 2 | Good | (slow) |
| Toluene | 110.6 | 10 | 1 | Dull | Too slow |
| | | 10 | 2 | Good | |
| Methylene chloride | 39.8 | 10 | 1 | Good | |
| | | 10 | 2 | Surface sealed | Too rapid |
| 1,1,1-trichloroethane | 74 | 15 | 1 | Good | |
| (chlorothene) | | 10 | 2 | Good | |

EXAMPLE 13

In order to determine how much the MFT of the main bonding agent should be above the drying temperature used in order that porous powder, adhering well to the base and with a smooth surface is to be obtained, 3 mixtures were made with temporary bonding agent according to example 1, to 5% of the dry volume. The dispersions with main bonding agent were:

(A) According to example 1 (methyl methacrylate only as monomer) Tg approx. 100°.

(B) Copolymer between 60% methyl methacrylate and 40% butyl acrylate, made exactly in the same way as the main bonding agent according to example 1, and with the same particle size as this. MFT=41°.

(C) Copolymer between 55% methyl methacrylate and 45% butyl acrylate according (B) for the rest. MFT=26°.

The mixtures were thickened with the type and quantity according to example 3. Application with a brush on glass to thicknesses corresponding to 25 and 100 μm dried and exposed coating, of each mixture.

During the drying, which took place at 25° C. and relative humidity=50%, the following powder coatings were obtained:

(A) 25 μm—smooth, white, coating, free from cracks
(A) 100 μm—smooth, white, coating, free from cracks
(B) 25 μm—smooth, white, coating, free from cracks
(B) 100 μm—smooth, white, coating, free from cracks
(C) 25 μm—partly transparent coating, with cracks
(C) 100 μm—transparent coating with through cracks with a width of 2-3 mm, from the base and up to the air surface.

the sheets were exposed to solvent in an apparatus according to example 1.

(A) Exposed to acetone for 10 secs, and (B) and (C) to toluene vapour for 10 secs. (A) with 25 μm and (B) with 25 μm and 100 μm gave smooth, transparent coatings, free from cracks.

(A) with 100 μm could not be exposed, as flakes of the paint coating curled up and loosened at the first contact with the solvent vapour.

(C) with 25 and 100 μm gave well adhering coatings, with cracks.

The example shows:

(1) MFT for the main bonding agent should be 15° above the drying temperature used.

(2) Hard particles do not adhere as well to a base as soft particles with the same content of temporary bonding agent.

The main bonding agent and the temporary bonding agent, as well as the proportion between these, must thus be chosen with consideration to the base used, the drying time used, and the thickness of the coating used.

EXAMPLE 14

A mixture was made of three dispersions, A, B and C, with the dry volume proportion of 50/60/35.

A. Dispersion A was temporary bonding agent according to example 1.

B. Dispersion B was a copolymer between 70% methyl methacrylate and 30% butyl acrylate with particle size = 0.40 μm according to example 12.

C. Dispersion C was made with 5-stage emulsion polymerization, with the following components:

| | parts by weight | |
|---|---|---|
| Methyl methacrylate | 546 | 91% |
| Methacrylic acid | 54 | 9% |
| Sodium lauryl sulphate | 6 | |
| Non-ionic emulsifier[x] | 12 | |
| Ammonium persulphate | 0.5 | |
| Disodium hydrogen phosphate | 3 | |
| Distilled water | 900 | |

The particle size was 0.1 μm.

[x]Berol 09 from Berol Kemi AB

The mixture was thickened with the quantity and type according to example 7. It was applied with a brush on masonite sheets to a thickness corresponding to 30 μm dried, exposed coating. The drying took place in room temperature. The solvent treatment was made with an azeotrope vapour mixture of ethyl acetate and water (92/8) in an apparatus according to example 1, during 12 seconds. After drying in room temperature for 5 minutes, a transparent, high-gloss, hard, smooth and well adhering coating was obtained.

EXAMPLE 15

Mixtures were made of 5% counted on the dry volume of temporary bonding agent according to example 1 and particle dispersions containing various quantities of acrylonitrile, according to the table.

Thickening took place according to example 2. Spraying on steel plate to a thickness corresponding to 25 μm dried, exposed coating. Drying took place at room temperature. Exposure to acetone for A and B with 10 and 20 seconds exposure time, respectively, in an apparatus according to example 1. For C, an apparatus according to example 6 was used, in which dimethylformamide vapour+nitrogen gas in proportion 1:1 and with a temperature of 152° was blown on the coating. After-drying in a heating chamber at 80° during 1 hour, and cooling to room temperature.

TABLE

| | Methyl methacrylate | Acrylonitrile | Other monomers | Type | Particle size | Emulsifier |
|---|---|---|---|---|---|---|
| A | 78 | 20 | 2-methacrylic acid | Emulsion polymer | 0.25 μ | Non-ion |
| B | | 58 | 2-methacrylic acid 40-butyl acrylate | Emulsion polymer | 0.25 μ | " |
| C | | 100 | | Precipitation polymer | 10–40 μm | Aggregate of porous particles |

The coatings obtained were transparent, smooth and glossy. The adhesion to the plate and the toughness of the film were so good that the plate could be bent to very sharp angles, without any damage to the coating.

EXAMPLE 16

A mixture was made of a dispersion containing
95% methyl methacrylate
5% glycidyle methacrylate
and with other components and procedure as for the main bonding agent according to example 1 and a temporary bonding agent according to example 5, to 3% counted on the dry volume of the latter. Thickening took place according to example 2. The mixture was sprayed on to aluminium sheets to a thickness corresponding to a 35 μm dried and exposed coating. After drying at room temperature, the sheets were treated with acetone vapour for 10 seconds according to the procedure as per example 1. After-treatment took place in a drying chamber at 120° during 30 minutes. A test of the cross-linking of the coating was made with liquid acetone at room temperature during 1 hour. The coating did not swell at all, which shows that cross-linking took place between the oxirane groups during the heat treatment after the solvent treatment.

EXAMPLE 17

Mixtures were made of temporary bonding agent according to example 1 in quantities corresponding to 5% counted on the dry volume and dispersions containing copolymers containing methacrylic acid. See table:

| | Methyl methacrylate | Methacrylic acid | Other monomers | Dry content | Particle size | Emulsifier |
|---|---|---|---|---|---|---|
| A | 71 | 4 | 25 butyl acrylate | 45 | 0.25 | Non-ion |
| B | 91 | 9 | — | 40 | 0.1 | Anion + non-ion |
| C | 42 | 15 | 43 butyl acrylate | 40 | 0.1 | Anion + non-ion |

Thickening took place according to example 2. The mixtures were sprayed on glass to a thickness corresponding to 20 μm dried, exposed coating. After drying at room temperature, exposure to acetone vapour for 10 seconds, according to the procedure as per example 1.

After 10 minutes drying at room temperature, a transparent, hard coating, well adhering to the base, was obtained.

EXAMPLE 18

A mixture was made of
(a) 5% counted on the dry volume of temporary bonding agent according to example 1.
(b) 75% counted on the dry volume of a dispersion with the monomer composition
90% methyl methacrylate
10% 2-ethyl-hexyl acrylate
With other components and procedure as for the main bonding agent according to example 1.
(c) A pigment paste with titanium dioxide pigment to 20 concentration of pigment volume (CPV) with the composition

| | parts by weight |
|---|---|
| titanium dioxide RNCX from Kronos Titan | 370 |
| distilled water | 347 |
| Orotan 731* 25% | 13 |
| Non-ionic emulsifier | |
| Berol 09 from Berol Kemi AB | 3 |
| Anti-foam H:10 from Dow 50% | 4 |

*Rohm and Haas

The paint, for which no further thickening was required, was applied with a brush on a sheet of eternite to a thickness corresponding to 35 μm dried, exposed coating. Drying took place at room temperature. Exposure took place for 20 seconds in acetone vapour in an apparatus according to example 1.

After-drying took place at room temperature during 2 hours. A high-gloss, smooth, completely covering and well adhering coat of paint was obtained.

EXAMPLE 19

A mixture of
(A) 5% counted on the dry volume of temporary bonding agent in dispersion according to example 1.
(B) 80% counted on the dry volume of a dispersion with the monomer composition 70% methyl methacrylate, 30% ethyl acrylate and other components and the procedures as for the main bonding agent according to example 1.
(C) A pigment paste containing red iron oxide pigment to 15 CPV. Other components of the paste as for the paste according to example 5.

The mixture was thickened according to example 2, and applied to chipboard to a thickness corresponding t 30 μm. Drying at room temperature. Exposure in an apparatus according to example 1 to acetone vapour. After drying for 1 hour at room temperature, a hard, well adhering, glossy, smooth coating was obtained.

EXAMPLE 20

A mixture of 5% counted on the dry volume of temporary bonding agent dispersion according to example 1 and dispersion with the monomer composition 95% methyl methacrylate and 5% hydroxy-ethyl acrylate was made. This latter dispersion was made in the same way as the main bonding agent according to example 1. Thickener according to example 2 was added to the mixture. The mixture was sprayed on glass sheets to a thickness corresponding to 50 μm dried, exposed coating. Drying took place at room temperature. The exposure took place by brushing on methyl ethyl ketone, containing (A) 13% Desmodur N 75[x] and 0.5%dibutyl stannic dilaurate
(B) 13% Desmodur N 75[x]
(C) Methyl ethyl ketone only
[x]From Bayer Drying took place at room temperature.

In all cases, transparent coatings were obtained. 24 hours after the solvent had been applied, the coatings were tested with liquid acetone. It proved that (A) did not swell when acetone was applied, (B) swelled somewhat, and (C) was entirely soluble. In both cases (A) and (B) a cross-linking had thus taken place between the isocyanate groups in the Desmodur 75 and the hydroxyl groups in the polymer. Cross-linking had taken place at room temperature.

EXAMPLE 21

A mixture of 10% counted on the dry volume of the temporary bonding agent according to example 1 and a dispersion containing 90% methyl methacrylate and 10% diacetone acrylamide in the other components, and with the procedure as for the main bonding agent according to example 1 was made. The mixture was thickened according to example 3. It was applied to steel wire by this being dipped into the mixture. This was carried out in such a way that the wire, in a slow, continuous movement was moved in an arc through the bath with the mixture. The drying took place at room temperature during 2 hours. The exposure took place by the wire, in a slow continuous movement being allowed to pass through vapour with the azeotrope 92% ethyl acetate and 8% water at its boiling point (70.4° C.). The time in the vapour was approx. 15 seconds. Drying took place at room temperature during 1 hours. A transparent, smooth, high-gloss coating was obtained. The wire could be bent sharply, and the coating neither loosened nor was damaged.

EXAMPLE 22

A mixture of 5% counted on the dry volume of a dispersion containing temporary bonding agent according to example 1 and main bonding agent dispersions containing polystyrene was made, according to the table.

| | Styrene | Other monomers | Emulsifier | Particle size | Dry content |
|---|---|---|---|---|---|
| A | 100% | | According to main bonding agent example 1 | | |
| B | 80% | 2-ethyl hexyl acrylate 20% | According to main bonding agent example 1 | | |

The mixtures were thickened according to example 3 and applied on masonite sheets to a thickness corresponding to 40 μm dried, exposed coating. Drying at room temperature. Exposures were made to solvents, and results according to the table in an apparatus according to example 6 with solvent vapour at its boiling point with the proportion boiling point/nitrogen gas=1/1.

| | | |
|---|---|---|
| Freon 11 | A | very slow, but functions |
| | B | " |
| Freon 112 | A | excellent after 10 s exposure |
| | B | " |
| Freon 113 | A | does not function |
| | B | " |
| n-heptane | A | functions very slowly |
| | B | " |
| tetra-hydro-furan | A | excellent after 10 s exposure |
| | B | " |

After two hours drying at 70°, the sheets exposed to Freon 11, Freon 112 and tetrahydrofuran gave entirely transparent, hard, glossy, well adhering coatings.

EXAMPLE 23

A mixture was made of 5% counted on the dry volume of temporary bonding agent according to example 1 and a dispersion containing 70% methyl methacrylate, 30% butyl acrylate and 0.1% on the monomer of tertiary dodecyl mercaptan. Other components and procedure as for the main bonding agent according to example 1. The mixture was thickened according to example 2, and applied to a sheet of glass with a brush to a thickness corresponding to 15 μm dried, exposed coating. Drying took place at room temperature. The exposure took place with methyl isobutyl ketone vapour at its boiling point (76.7° C.) during 15 seconds. After-drying for 60 minutes at room temperature. The lower molecular weight of the main bonding agent, as a result of the mercaptan added, had the result that good flowing took place, even in this thin coating, and with such a large particle size of the main bonding agent (0.4 μm). A smooth, high-gloss transparent coating was obtained.

EXAMPLE 24

A mixture was made of 5% counted on the dry content of a temporary bonding agent according to example 1 and a dispersion with the monomer composition of 98% methyl methacrylate and 2% of an ultra-violet absorbing monomer, according to

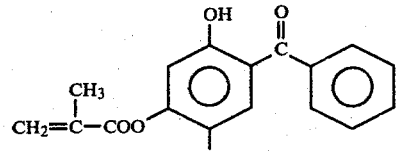

2.4-dihydroxy benzophenone methacrylate

Other components and procedure as for the main bonding agent according to example 1.

The mixture was poured into a Petri bowl to a thickness corresponding to 50 μm dry, exposed coating. As a reference, a test was made with the mixture according to example 1. The two dried powder coatings were exposed to ethyl acetate at room temperature. After drying, the ultra-violet absorption was measured in a spectrophotometer at different wave-lengths. The measurements were made directly on the films, after these had been removed from the glass, without being dissolved in solvent. The values of the transmission converted to exactly 50 μm film thickness with the Lambert-Beers law will be noted from the table.

| Wave-length nm | % Transmission UV abs. polymer film | Transmission reference |
|---|---|---|
| 290 | 0.64 | 39.6 |
| 300 | 2.94 | 49.5 |
| 310 | 2.94 | 49.5 |
| 325 | 1.44 | 63.7 |
| 340 | 1.44 | 66.8 |
| 355 | 7.73 | 70.9 |
| 370 | 41.0 | 71.8 |
| 385 | 72.8 | 72.7 |
| 400 | 74.7 | 72.9 |
| 425 | 77.9 | 73.2 |
| 500 | 80.5 | 74.3 |

As will be noted from the table, the UV transmission was reduced considerably with this polymer for wavelengths of less than 370 nm.

EXAMPLE 25

A mixture was made of 5% counted on the dry volume of a temporary bonding agent according to example 1 and a main bonding agent according to example 1. The mixture was applied unthickened to closely woven impregnated textile with a brush. Immediately thereafter carborundum grains were spread on the dispersion coating, to an almost covering monolayer. The dispersion then oriented itself around the grains, so that optimal use of the bonding agent was obtained as regards the fastening of the grains. Drying took place in a heating chamber at 40° C. during 2 hourss. The solvent treatment took place in an apparatus according to example 1, in which acetone vapour at its boiling point was allowed to act during 10 seconds. After-drying took place during 2 hours at room temperature. With a microscope, it could be established that the grains were baked into the polymer coating to approx. 65% of the height of the grains. The grains adhered very well, and the material was very suitable for polishing work.

EXAMPLE 26

A mixture of 5% counted on the dry volume of a temporary bonding agent according to example 1 and main bonding agent containing 100% ethyl methacrylate, and other components, dry content and procedure as for the main bonding agent according to example 1, was made. The mixture was thickened with 0.5 parts/100 parts 40% dispersion acrylic thickener[x] and the pH was adjusted to pH 9 with concentrated ammonia. The mixture was applied to plasterboard, on the pasteboard, to a thickness corresponding to 60 μm dried, exposed coating, Immediately thereafter, decorative grains of mineral approx. 1 mm were spread on to it, so that they covered approx. 5% of the surface.

[x]Rohagit SD-15 from Röhm

After drying at room temperature, the sheet was exposed to liquid methylene chloride, thickened with 1% high-molecular polymethyl methacrylate, which was brushed on at room temperature. After drying for 30 minutes at room temperature, a decorative surface with well adhering mineral grains was obtained in a glossy, transparent coating.

EXAMPLE 27

A mixture was made of 5% of the temporary bonding agent according to example 1 and 95% of the main bonding agent with the monomer composition 85% methyl methacrylate and 15% butyl acrylate and with other components and the procedure as for the main bonding agent according to example 1.

To this mixture was added 40 parts/100 dispersion mixture of an emulsion consisting of

| | | |
|---|---|---|
| 10% | benzyl peroxide | |
| 10% | non-ion emulsifier | Berol 09 from Berol Kemi AB |
| 80% | water | |

The mixture was thickened according to example 3, and applied to sheets of glass to a thickness corresponding to 60 μm dried, exposed coating. The drying took place at room temperature. The exposure to solvent took place in an apparatus according to example 1. In this apparatus, methyl methacrylate was boiled with an additive of 0.1% hydroquinone.

The sheets of glass were exposed to the monomer vapour during 3 and 15 minutes, respectively. Thereafter the sheets of glass were immediately placed in sealed glass vessels with little air volume which, in turn, were immediately placed in a heating chamber at 75° for 1 hour. After cooling to room temperature, high-gloss, well adhering, transparent, hard coatings were obtained. The thicknesses measured were 150 μm for the 3 minutes and 500 μm for the 15 minutes exposures. This shown that methyl methacrylate vapour at the boiling point functions both as a solvent for the powder coating and that it reacted so that adhesion was obtained.

EXAMPLE 28

Mixtures were made of 5% of the dry volume of the temporary bonding agent according to example 1 and (1) The main bonding agent according to example 1
(2) The main bonding agent according to example 1 +15 CPV black iron oxide pigment
(3) Main bonding agent with copolymer of 15 % butyl acrylate and 85% methyl methacrylate, and with other components and procedure as for the main bonding agent according to example 1
(4) As (3), but with 15 CPV black iron oxide pigment.

The mixtures were thickened according to example 3, and applied with a brush on eternite sheets, to a thickness corresponding to 40 μm dried, exposed coating. Drying took place at room temperature. The exposure took place in an apparatus according to example 1, to methyl ethyl ketone vapour during 20 seconds. After-drying took place at room temperature. For a comparative test, an eternite sheet was also prepared with a conventional acrylate dispersion coating. This paint consisted of a dispersion with copolymer between methyl methacrylate and butyl methacrylate with an MFT value of 28°. 15 CPV black iron oxide was also included. This paint was sprayed on to a sheet at 40°. The sheets were also dried at 40° in a heating chamber. All of the sheets were conditioned for 3 days in water at room temperature. Thereafter they were subjected to a freeze-thaw test, which consisted of freezing the sheets completely in a block of ice, after which they were thawed out again with water at room temperature running over the sheets. Each cycle consisted of 20 hours freezing in a freezer, followed by 4 hours thawing in water, and a judging of appearance of the sheets.

The results of the tests were that the comparative sample was uneffected during 5 cycles, after which cracks and blisters arose in the film.

In sample sheet 3, cracks appeared after 25 cycles. Sheets 1, 3 and 4 were entirely uneffected after 30 cycles.

EXAMPLE 29

A mixture was made of three dispersions, one of which was temporary bonding agent of the type and of the quantity according to example 16.

Dispersions containing main bonding agent were of two types, according to (A) Main bonding agent containing oxirane groups according to example 16.

(B) Main bonding agent containing carboxylic acid groups according to dispersion A in example 17.

The proportions of the mixture of the dispersion A and B were such that the molecular proportion of oxirane groups to the carboxylic acid groups was 1/1. The mixture was thickened according to example 2, and applied to aluminium sheets to a thickness corresponding to a 35 μm dried, exposed coating. Drying took place at room temperature during 3 hours. The sheets were exposed to acetone vapour in an apparatus according to example 1 for 10 seconds. Thereafter, they were dried and hardened in a heating chamber at 120° during 3 hours. A test of cross-linking of the coating was made with liquid acetone at room temperature during 1 hour. The coating swelled insignificantly, which shows that cross-linking took place between the oxirane and the carboxylic acid groups during the heat treatment after the solvent treatment.

EXAMPLE 30

A mixture was made of 95% counted on the dry content of main bonding agent containing carboxylic acid groups according to dispersion A in example 17 and temporary bonding agent containing 30% glycidyl methacrylate and 70% ethyl acrylate, and with the procedure as for the temporary bonding agent according to example 1. The mixture was thickened according to example 2, and applied on an aluminium sheet to a thickness corresponding to 35 μm dried, exposed coating. After drying at room temperature, the coating was exposed to acetone vapour according to example 1 for 10 seconds. After-drying took place at 120° C. during 3 hours. A test with liquid acetone at room temperature for 1 hour gave insignificant swelling, which shows that cross-linking took place in the coating between the oxirane groups and the carboxylic acid groups.

We claim:

1. A method of coating a surface with a coherent coating containing a polymeric material as the main bonding agent wherein said main bonding agent is not film forming at room temperature, but forms the coherent phase of the finished coating which comprises:

A. applying to said surface a dispersion containing said main bonding agent dispersed in an inert liquid forming the continuous phase in relation to the dispersed main bonding agent, said dispersion also containing a second and temporary bonding agent in an amount of 0.5–25% by volume based upon the total quantity of solids in the dispersion;

B. then allowing the continuous phase of the dispersion to evaporate or be driven off;

C. causing said main bonding agent to precipitate in the form of polymer particles having a diameter of 0.1–30 μm wherein the minimum film forming temperature (MFT) of said bonding agent is at least 20° C. above the temperature prevailing in the coating during step B above;

D. causing said temporary bonding agent to precipitate at the same time as said main bonding agent to form a porous powder layer on said surface, and wherein the minimum film forming temperature (MFT) of said temporary bonding agent is at least 20° C. below the MFT for said main bonding agent and is below the temperature prevailing in the coating during step B above, and wherein said temporary bonding agent is present in an amount sufficient to bond the particles of said main bonding agent to said surface with sufficiently strong adhesion forces to permit a certain handling of the porous powder layer thus obtained;

E. then exposing said porous powder layer to a solvent capable of dissolving said main bonding agent and causing the bonding agent particles to flow together to form a coherent coating;

F. then driving off any excess solvent and drying said coherent coating.

2. The method of claim 1 wherein the major portion of said polymer particles formed in step C have a diameter between 0.2 and 2 μm.

3. The method of claim 1 wherein said temporary bonding agent is present in an amount of 1–12% by volume based upon the total quantity of solids in the dispersion.

4. The method of claim 1 wherein said solvent has a boiling point of 0°–300° C.

5. The method of claim 1 wherein said solvent has a boiling point of 20°–140° C.

6. The method of claim 1 wherein said solvent has a boiling point of 35°–120° C.

7. The method of claim 1 wherein said temporary bonding agent precipitates in the form of particles of 0.1–1 μm.

8. The method of claim 1 wherein said temporary bonding agent precipitates in the form of particles of 0.05–0.5 μm.

9. The method of claim 1 wherein said main bonding agent contains reactive groups for cross-linking after being exposed to said solvent.

10. The method of claim 9 wherein said main bonding agent is comprised of at least two parts in the form of separate particles in the dispersion and each containing reactive groups for interreacting with each other after being exposed to said solvent and upon flowing together to form said coherent coating.

11. The method of claim 1 wherein said main bonding agent contains ultraviolet light absorbing groups.

12. The method of claim 1 wherein said main bonding agent contains corrosion inhibiting groups.

13. The method of claim 9 wherein said temporary bonding agent comprises reactive groups for interreacting with the reactive groups in said main bonding agent after exposure to said solvent.

14. The method of claim 1 wherein said temporary bonding agent is chemically unreactive with said main bonding agent and is elastomeric to a degree sufficient to improve the impact strength of the coherent coating.

15. The method of claim 1 wherein said inert liquid forming the continuous phase is water.

16. The method of claim 15 wherein said temporary bonding agent is water soluble.

17. The method of claim 16 wherein said temporary bonding agent further provides for conrolling the consistency of the dispersion.

18. The method of claim 9 wherein a consistency controlling agent is added to said dispersion and wherein said consistency controlling agent comprises reactive groups for interreacting with the reactive groups of said main bonding agent after exposure to said solvent.

19. The method of claim 13 wherein as consistency controlling agent is added to said dispersion and wherein said consistency controlling agent comprises reactive groups for interreacting with the reactive groups of said main bonding agent after exposure to said solvent.

20. The method of claim 1 wherein said dispersion further comprises a pigment in an amount up to 50% concentration of pigment volume (CPV) and wherein the major portion of the size of the particles of said main bonding agent formed in step C does not substantially exceed the grain size of the pigment.

21. The method of claim 1 wherein said dispersion further comprises a pigment in an amount 5–25% CPV and wherein the major portion of the size of the particles of said main bonding agent formed in step C does not substantially exceed the grain size of the pigment.

22. The method of claim 1 wherein said dispersion further comprises large grains of up to 5 mm in a maximum amount not substantially exceeding 50% of the total volume of the coherent coating.

23. The method of claim 22 wherein said grains are abrasive grains.

24. The method of claim 1 wherein said dispersion further comprises an acid-emitting acid selected from the group consisting of potassium chlorate, potassium perchlorate or mixtures thereof, or further comprises an explosive nitro containing compound.

25. The method of claim 9 wherein said solvent contains catalyst for promoting the reaction of said reactive groups of said main bonding agent.

26. The method of claim 1 wherein said solvent comprises a polymer dissolved therein.

27. The method of claim 9 wherein said solvent comprises a polymer dissolved therein containing reactive groups for reacting with said reactive groups of said main bonding agent.

28. The method of claim 1 wherein said solvent comprises monomer capable of polymerizing in the presence of an initiator or heat or ultraviolet light.

29. The method of claim 1 wherein the MFT of said main bonding agent is greater than 45° C.

30. The method of claim 1 wherein said main bonding agent has a molecular weight of between 500,000 and 1,000,000.

* * * * *